US008019208B2

(12) United States Patent
Altman et al.

(10) Patent No.: US 8,019,208 B2
(45) Date of Patent: Sep. 13, 2011

(54) STEAM GENERATING APPARATUS WITH WATER-COOLED SOLID STATE SWITCH

(75) Inventors: Mitchell Altman, Woodland Hills, CA (US); Scott Sharitz, Oxnard, CA (US)

(73) Assignee: Mitchell Altman, Simi Valley, CA (US)

( * ) Notice: Subject to any disclaimer, the term of this patent is extended or adjusted under 35 U.S.C. 154(b) by 508 days.

(21) Appl. No.: 12/125,019

(22) Filed: May 21, 2008

(65) Prior Publication Data

US 2009/0290858 A1 Nov. 26, 2009

(51) Int. Cl.
*F24H 1/10* (2006.01)

(52) U.S. Cl. ..... 392/485; 392/465

(58) Field of Classification Search ..... None
See application file for complete search history.

(56) References Cited

U.S. PATENT DOCUMENTS 5,438,642 A * 8/1995 Posen ..... 392/485
5,626,287 A * 5/1997 Krause et al. ..... 236/20 R
6,002,114 A * 12/1999 Lee ..... 219/501
6,173,118 B1 * 1/2001 Harris ..... 392/451
6,647,204 B1 * 11/2003 Hutchinson ..... 392/491
7,046,922 B1 * 5/2006 Sturm et al. ..... 392/482

* cited by examiner

*Primary Examiner* — Thor Campbell
(74) *Attorney, Agent, or Firm* — Seldon & Scillieri

(57) ABSTRACT

A steam generating system for use in a steam bath includes thermostatically controlled steam generating means for maintaining the steam bath environment at a desired temperature, means defining a water inlet path for conducting water from a water supply to the steam generating means, said inlet-defining means including an area of highly thermally-conductive material in thermal contact with the water. The thermostatically controlled steam generating means includes an electrically powered heating element, and a solid state switching device for controlling the amount of electricity flowing in the heating element. The solid state switching device is in thermal contact with said highly thermally-conductive material so that the switching device is cooled via heat transfer to the water flowing in the inlet path.

6 Claims, 1 Drawing Sheet

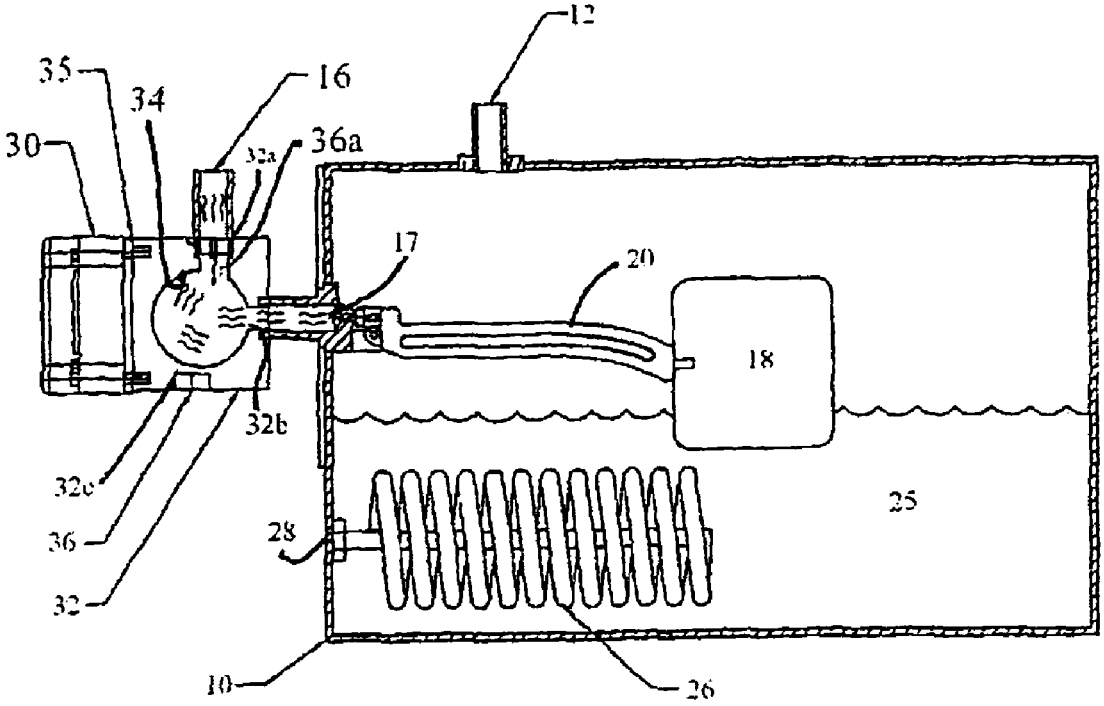
12
35
34
16
30
32a
36a
17
20
18
32b
32c
36
32
28
25
10
26

STEAM GENERATING APPARATUS WITH WATER-COOLED SOLID STATE SWITCH

FIELD OF INVENTION

This invention relates to steam generating apparatus for providing live steam to a shower or other enclosed area to create a steam room, and more particularly to the cooling of components of the steam generating apparatus

BACKGROUND OF THE INVENTION

Steam baths conventionally comprise a steam generator, a steam dispensing head and a thermostat responsive to the temperature of the steam bath environment to maintain a desired temperature by selectively activating and deactivating the generation of steam. Early steam bath systems used thermostats comprising electrical contactors that turned the steam fully on or completely off, as needed. Such systems, however, typically resulted in significant temperature overshoots followed by a fall off in temperature to a point substantially below the desired temperature. In addition to energy inefficiencies caused by such hysteresis, systems of this type suffered from noise created by the system. Upon activation, steam would rush out of the steam dispensing head with an audible sound until the steam would be shut off by the opening of the contactors. This, in turn, would typically cause a further disturbing sound. As steam baths moved out of commercial environments and into private homes, the noises and energy waste became increasingly undesirable.

Newer steam bath systems accordingly began to employ electronic controls which reduced hysteresis and resulted in quieter operation. Rather than being fully on or completely off, steam could be generated at an adjustable rate between those two extremes to heat the steam environment and then maintain it at the desired temperature with a relatively low rate of steam generation that generally offset the cooling of the environment.

The use of electronic controls, however, created a need for reliably cooling its electronic components to avoid temperature-related system failures. By way of example, a typical 15 kilowatt heater employed to generate 15 lbs of steam per hour can draw approximately 70 amps of current through the electronic switching used to control the environment's temperature. Consequently, the switching devices (e.g., triacs) have been mounted on relatively large heat sinks, and fans have been used to enhance thermal transfer away from the switching devices as well. The use of heat sinks and fans have not only added to the cost and size of the systems, but have frequently become a source of problems in themselves. In addition to the potential for normal fan failures, the fans and switching devices of steam baths are typically mounted out of sight in dirty and/or dusty environments such as attics, basements and the like, where they are virtually never inspected or cleaned until there is a failure. Heat sinks become less efficient as dirt accumulates on them, and fans become less reliable in such environments as well. One need only look at the fan on the back of one's personal computer to appreciate how dirt and dust accumulate even in the relatively clean working and living quarters of an office or home.

SUMMARY OF THE DISCLOSURE

The steam generating system herein includes thermostatically controlled steam generating means for maintaining the steam bath environment at a desired temperature, means defining a water inlet path for conducting water from a water supply to the steam generating means, said inlet-defining means including an area of highly thermally-conductive material in thermal contact with the water, said thermostatically controlled steam generating means including a solid state switching device in thermal contact with said highly thermally-conductive material so that the switching device is cooled via heat transfer to the water via the highly thermally-conductive material.

Greater details of the invention will be given herein below in the following description of the preferred embodiment thereof of which the accompanying drawings form a part. Neither the description of the preferred embodiment nor the accompanying drawings are to be construed to limit the invention. Rather, the scope of this invention is intended to be limited only by the prior art.

IN THE DRAWINGS

The sole FIGURE is a schematic view of a steam bath generator system constructed in accordance with the invention.

DETAILED DESCRIPTION OF THE PREFERRED EMBODIMENT

By way of example, the sole FIGURE herein FIG. 1 is a schematic view of a steam bath generator system constructed in accordance with the invention.

The steam generating system preferably comprises a stainless steel boiler tank 10 which can be of any convenient size and shape. The tank 10 has a steam outlet port 12, which is typically ½" in diameter, as well as a water inlet port 16 through which water enters the tank via an external inlet nipple from an inlet pipe (not shown). A float 18, inserted into the tank through the inlet port 17, extends within the tank from a stem 20 is operatively connected to a flapper valve at the inlet port 17 to close the flapper when the level of water 25 in the tank reaches the maximum desired level, and to open the flapper when the water level is lower than the maximum desired level to permit the ingress of more water.

A heater coil 26 is inserted into the tank through a coil-receiving port 28 to heat the water to its boiling point and thereby create the steam that emerges from the steam outlet port. The heater coil 26 is an electrically resistive element that is responsive to the flow of electricity within the coil to sufficiently heat the water in which it is immersed to raise the water temperature to the boiling point. Preferably, the heating coil is a 220 volt, 15 KW heater. The heating coil 26 is electrically coupled through a circuit board (not shown) to a source of household current.

Those skilled in the art will recognize that is the heating element 26 need not be coil shaped, and that any desirable configuration for the heating element can be used.

The steam emanating from the tank 10 exits from the housing through the steam discharge port 12, and is conducted towards the steam bath enclosure by a steam outlet conduit that is typically screwed into the port or sealingly fastened to it by other appropriate means.

In accordance with the invention, a highly thermally-conductive material such as brass is placed in thermal contact with the incoming water. The term "thermal contact" is used to mean that heat is exchanged between the two components but that that they are not necessarily in direct physical contact. The material contacting the water should be non-corrosive in that fluid. In addition to brass, acceptable materials include stainless steel, certain ceramics and certain plastic materials, and combinations of the foregoing.

As illustrated in the FIGURE, a housing 32 formed in whole or in part from such material has an internal passageway forming a portion of the incoming water's inlet path. A solid state relay, solenoid or solid state switch (collectively referred to herein as a switching device 30) is mounted in heat-transfer relationship with the thermally conductive housing material so that the switching device 30 is cooled via heat transfer to the water via the highly thermally-conductive material. An example of a solid state switching device 30 is a triac. Cooling occurs at 35, substantially along a plane that extends at 90° to the plane of the FIGURE. Naturally, cooling along other surfaces and surface shapes can be created by design without departing from the scope of the invention. Those of ordinary skill in the art will recognize that direct physical contact between the solid state switching device and the thermally-conductive material is preferable for maximum heat transfer, but not necessary if requisite heat transfer can otherwise occur. Thus, it may be possible or desirable to have a layer of material between the switching device and thermally-conductive material for electrical insulation purposes, etc. so long as adequate thermal exchange takes place.

It can be noted that no additional power source is required for this cooling method; it simply uses the water pressure in the inlet line. Moreover, its cooling affect increases as water volume increases during periods in which more steam must be generated. Accordingly, a bypass switch 36 or solenoid device may be provided for switching between normal steam bath operation and a "power-flush" operation whereby water from the inlet is respectively conducted into the tank 10 or to the steam head (or other outlet).

The resulting configuration lends itself to a solid state switching device (with or without associated electronics) that is mounted integrally with the water inlet, although those of ordinary skill in the art will recognize that the solid state switch can be placed in thermal contact with the water anywhere along the water inlet line upstream of the holding tank.

The typical production of 15 lbs of steam/hour requires 6 gallons of water per hour to pass through the inlet, providing excellent cooling capacity. Because of the continual cooling with fresh and relatively cool water as the water flows through the inlet, the required "heat sink" area is minimized.

Various modifications and changes may be made to the illustrated structure without departing from the spirit and scope of the invention as set forth in the following claims.

What is claimed is:

1. A steam-generating system for generating steam for use within a steam bath environment comprising:

a water-holding tank having a water inlet port and a steam outlet port;

a valve operatively positioned with respect to the water inlet port for permitting the ingress of water into the tank when opened, and for blocking the ingress of water into the tank when closed;

a level sensor responsive to the level of water within the tank for selectively opening and closing said valve to substantially maintain the water near a desired level;

an electrically conductive heating element positioned within the tank and responsive to the passage of electricity through the element to heat the water to its boiling point;

a body of highly thermally-conductive material positioned upstream of the water-holding tank, and having an internal water-conducting passageway for directing incoming water from a water supply to the inlet port, said body of highly thermally-conductive material being in thermal contact with the water, and a thermostat for maintaining the water within the tank at substantially a desired temperature, the thermostat including a solid state switching device in thermal contact with said highly thermally-conductive material so that the switching device is cooled via heat transfer to the water via the highly thermally-conductive material.

2. The steam-generating system of claim 1 wherein the thermally-conductive material is selected from the group consisting of brass, stainless steel, ceramic, plastic and a combination of a plurality thereof.

3. The steam-generating system of claim 2 wherein the thermally conductive material is substantially non-corrosive in water.

4. The steam-generating system of claim 1 wherein the switching device is selected from the group consisting of a solid state relay, a solenoid and a triac.

5. The steam-generating system of claim 1 wherein the solid state switching device is in direct physical contact with the thermally-conductive material.

6. For use with a steam-generating system of the type utilized to generate steam for a steam bath environment utilizing water from a water supply, and of the type including:

a water-holding tank having a water inlet port and a steam outlet port, thermostatically controlled steam generating means for maintaining the steam bath environment at a desired temperature, said thermostatically controlled steam generating means including an electrically powered heater element within said tank for heating water therein sufficiently to produce steam, and a solid state switching device for controlling the flow of electricity applied to the heater element, and means defining a water inlet path for conducting water from the water supply to the water inlet port, a heat dissipating configuration for the solid state switching device comprising:

an area of highly thermally-conductive material positioned upstream of the water inlet port and in thermal contact with the water flowing in the inlet path, said area being in thermal contact with the solid state switching device so that the switching device is cooled by heat transfer to the water flowing towards the inlet port.

* * * * *